US005248144A

United States Patent [19]

Ullerich

[11] Patent Number: 5,248,144

[45] Date of Patent: Sep. 28, 1993

[54] DRIVING RANGE GOLF TEE

[76] Inventor: Scott R. Ullerich, 4450 Spencer St., Torrance, Calif. 90503

[21] Appl. No.: 933,829

[22] Filed: Aug. 24, 1992

[51] Int. Cl.[5] ..... A63B 69/36

[52] U.S. Cl. ..... 273/187.1; 273/202

[58] Field of Search ..... 273/202, 203, 187.1, 273/195 R, 195 A, 195 B, 35 B

[56] References Cited

U.S. PATENT DOCUMENTS 1,779,995 10/1930 Trane ..... 273/203

4,465,281 8/1984 Whitfield ..... 273/187.1 X

FOREIGN PATENT DOCUMENTS 519193 3/1940 United Kingdom ..... 273/202

*Primary Examiner*—George J. Marlo

*Attorney, Agent, or Firm*—Leon Gilden

[57] ABSTRACT

A golf tee for use on a driving range is arranged for reception through an aperture within a respective mat as utilized in a driving range. The golf tee structure includes a base having an internally threaded cylindrical tube orthogonally mounted to the base, with the golf tee having an externally threaded body adjustably mounted within the tube. An upper wall of the golf tee is formed with a concave surface to accommodate a golf ball thereon. The lower end of the externally threaded body can be seen through a viewing slot in the support tube and its position marked by the pointed end of an indicator plate detachably mounted by barbs to a fibrous strip located adjacent the viewing slot.

1 Claim, 4 Drawing Sheets

DRIVING RANGE GOLF TEE

BACKGROUND OF THE INVENTION

1. Field of the Invention

The field of invention relates to adjustable golf tee structure, and more particularly pertains to a new and improved driving range golf tee wherein the same is arranged for adjustment relative to a driving range flexible mat.

2. Description of the Prior Art

In driving ranges as typically utilized in practice at golf courses and the like, a flexible mat is provided having an aperture therethrough, with the aperture arranged for receiving a golf tee. Height positioning of the tee relative to the underlying support surface is limited. The instant invention attempts to overcome deficiencies of the prior art by providing for a golf tee for use in combination with the driving range mat having an adjustable support rod for mounting a golf ball at an upper end thereof. Prior art adjustable type golf tee structure is indicated the U.S. Pat. No. Des. 306,751, U.S. Pat. Nos. 3,467,390; 4,516,780; and an anchored golf tee structure as indicated in U.S. Pat. No. 4,114,878.

As such, it may be appreciated there continues to be a need for a new and improved driving range golf tee as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of golf tee apparatus now present in the prior art, the present invention provides a driving range golf tee wherein the same employs an adjusting rod adjustably mounted relative to a receiving support tube. As such, the general purpose of the present invention, which will be described subsequently in greater detail, is to provide a new and improved driving range golf tee which has all the advantages of the prior art golf tee apparatus and none of the disadvantages.

To attain this, the present invention provides a golf tee for use on a driving range arranged for reception through an aperture within a respective mat as utilized in a driving range. The golf tee structure includes a base having an internally threaded cylindrical tube orthogonally mounted to the base, with the golf tee having an externally threaded body adjustably mounted within the tube. An upper wall of the golf tee is formed with a concave surface to accommodate a golf ball thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved driving range golf tee which has all the advantages of the prior art golf tee apparatus and none of the disadvantages.

It is another object of the present invention to provide a new and improved driving range golf tee which may be easily and efficiently manufactured and marketed.

It is a further object of the present invention to provide a new and improved driving range golf tee which is of a durable and reliable construction.

An even further object of the present invention is to provide a new and improved driving range golf tee which is susceptible of a low cost of manufacture with regard to both materials and labor, and which accordingly is then susceptible of low prices of sale to the consuming public, thereby making such driving range golf tees economically available to the buying public.

Still yet another object of the present invention is to provide a new and improved driving range golf tee which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
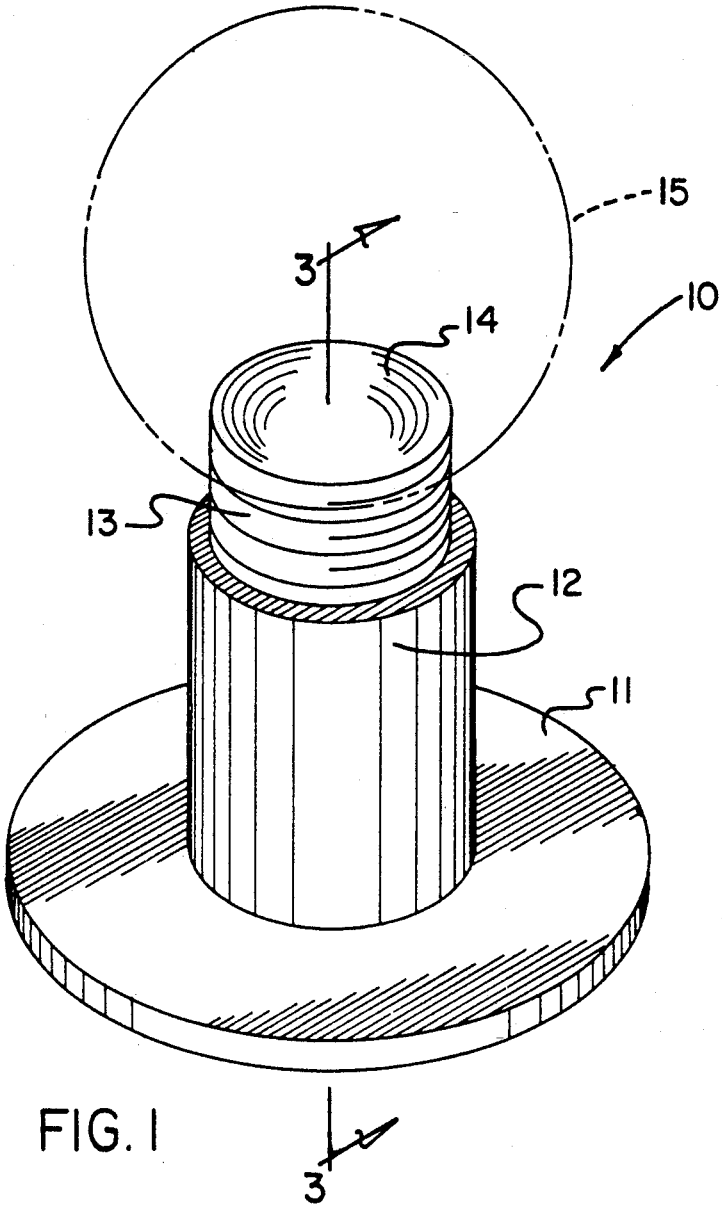
FIG. 1 is an isometric illustration of the instant invention.
Figure 2:
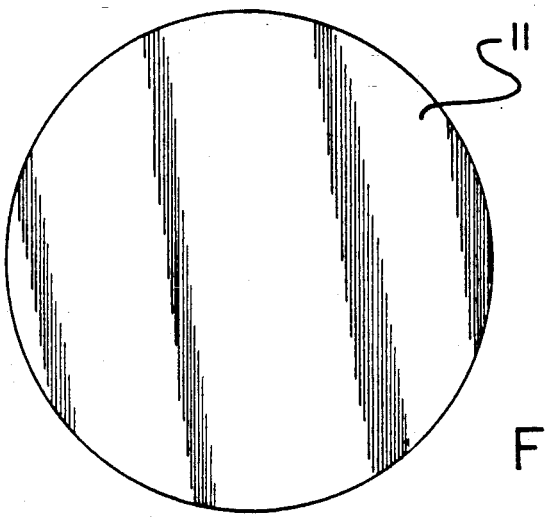
FIG. 2 is an orthographic bottom view of the invention.
Figure 3:
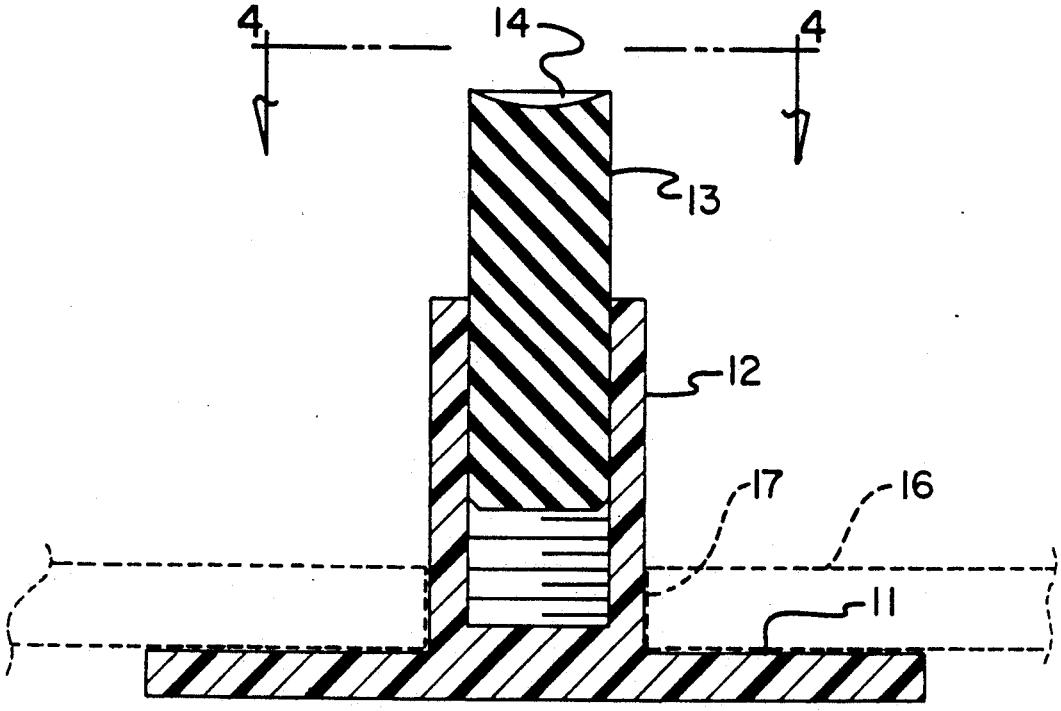
FIG. 3 is an orthographic view, taken along the lines 3—3 of FIG. 1 in the direction indicated by the arrows.
Figure 4:
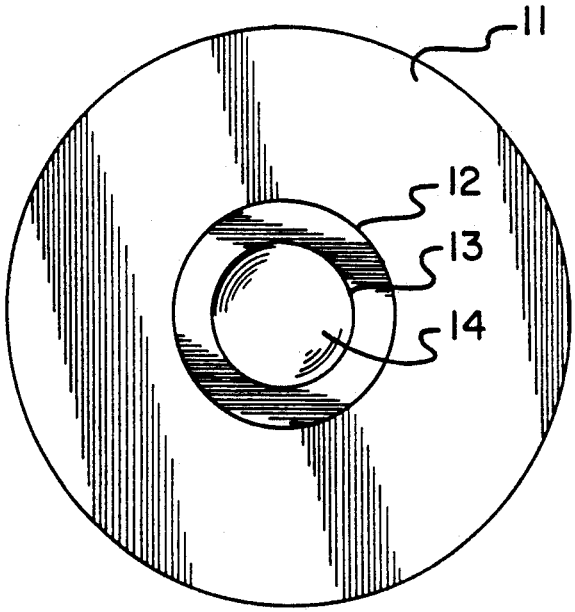
FIG. 4 is an orthographic view, taken along the lines 4—4 of FIG. 3 in the direction indicated by the arrows.
Figure 6:
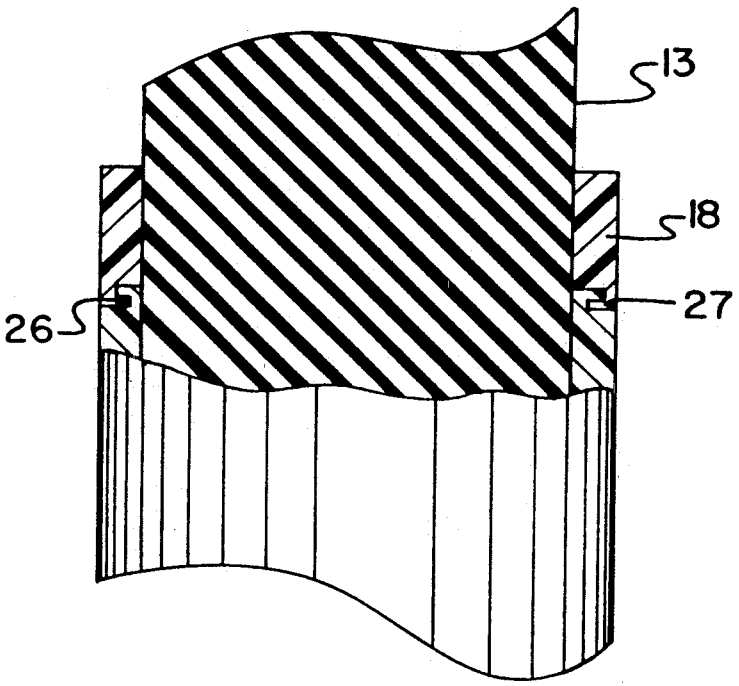
FIG. 6 is an orthographic view, taken along the lines 6—6 of FIG. 5 in the direction indicated by the arrows.

With reference now to the drawings, and in particular to FIGS. 1 to 10 thereof, a new and improved driving range golf tee embodying the principles and concepts of the present invention and generally designated by the reference numeral 10 will be described.

More specifically, the driving range golf tee 10 of the instant invention essentially comprises a base plate 11 having a planar bottom wall and of a predetermined first width, with an internally threaded support tube 12 of a second width less than the first width orthogonally and medially mounted to a top surface of the base plate 11. The base plate 11 is typically of a circular configuration for convenience but may be of any desired configuration, as the base plate 11 is arranged for positioning below an associated flexible mat 16 having an aperture 17 therethrough for receiving the support tube 12. The aperture 17 is of an aperture width less than said first width but greater than said second width. An externally threaded support rod 13 is threadedly received within the support tube 12 in an adjustable and extensible relationship, with the support rod 13 having a support rod concave top wall 14 spaced from the support tube 12 arranged for accommodating a golf ball 15 thereon in an adjustable height relationship relative to the base plate 11.

In this manner, the golf tee structure 10 is arranged for positioning below the support mat, wherein subsequently the support rod 13 is threadedly directed relative to the support tube 12 to provide for adjustable height and positioning of the golf ball 15 relative to the base plate 11, as well as the mat structure 16.

Figure 5:
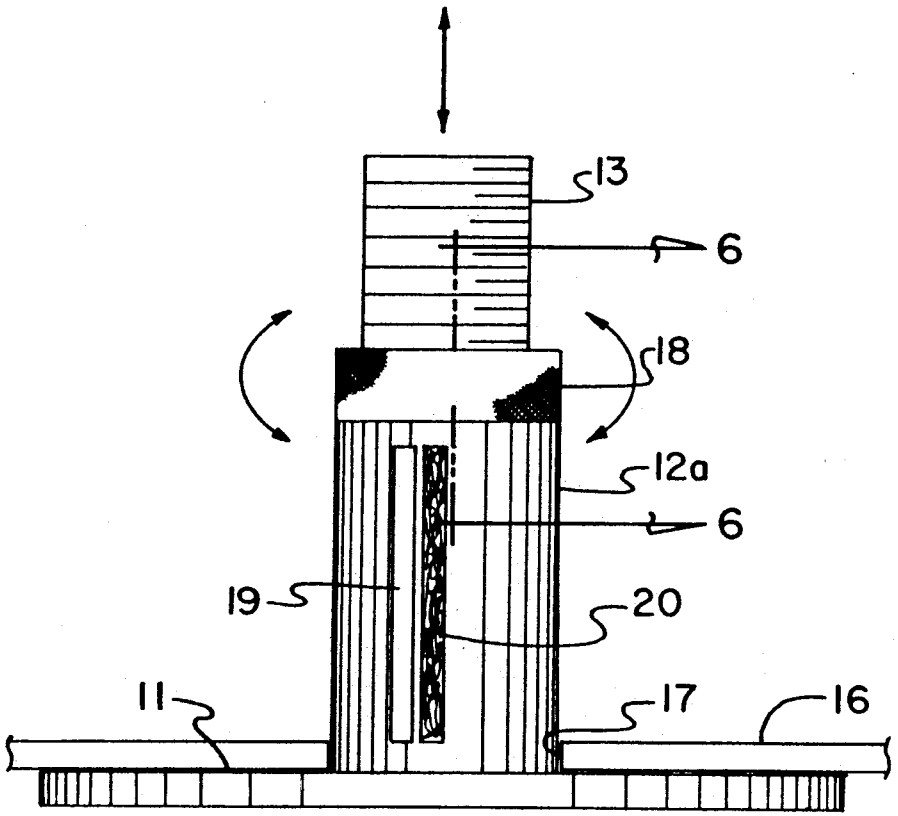
FIG. 5 is an orthographic side view of a modified golf tee structure utilized by the invention.

The FIG. 5 for example indicates the use of a locking collet 18 mounted to an upper distal end of a modified support tube 12*a*, wherein the locking collet 18 is arranged to employ a cam follower 27 received within a cam slot 26. As the collet 18 is of a resilient construction arranged for maintaining orientation of the support tube relative to the support rod 13, the rotation of the cam follower 27 within the cam slot permits the resilient collet to provide for a more firm grasp of the support rod 13 relative to the modified support tube 12*a* when positioned in a predetermined orientation relative to one another.

Figure 8:
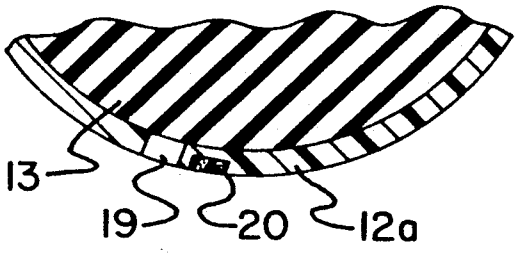
FIG. 8 is an orthographic view, taken along the lines 8—8 of FIG. 7 in the direction indicated by the arrows.
Figure 9:
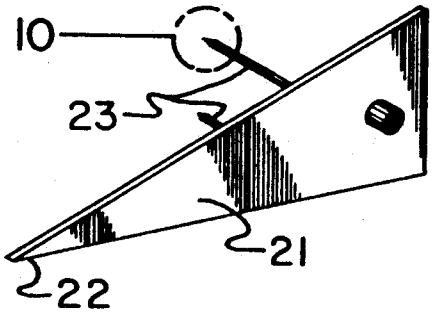
FIG. 9 is an isometric illustration of the indicator plate utilized by the invention.
Figure 7:
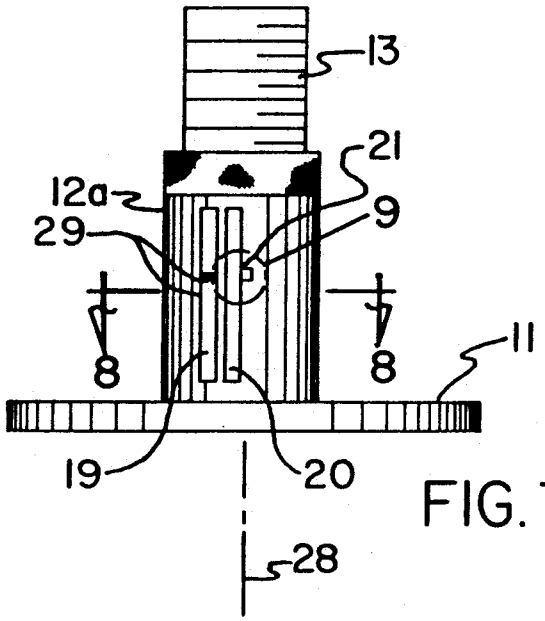
FIG. 7 is an orthographic side view of the invention employing an indicator member therewith.
Figure 10:
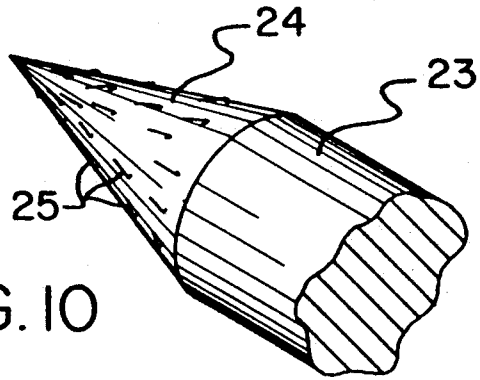
FIG. 10 is an isometric illustration of section 10 as set forth in FIG. 9.

The organization as indicated in the FIGS. 5, 7, and 8 includes a viewing slot 19 having an adjacent and parallel fibrous strip 20. The viewing slot 19 is directed in a through-extending relationship relative to the support tube 12*a* arranged parallel to an axis 28. It is noted that the base plate 11, as well as the support tube 12 or 12*a* and the support rod 13, are in a coaxially aligned relationship relative to one another. For convenience relative to maintaining and re-registering of the support tube and the support rod relative to the support tube, the viewing slot 19 permits observation of a lower distal end 29 of the support rod 13. Upon such observation, an indicator plate 21 is provided having a plate pointed end 22 positioned in adjacency relative to the lower distal end 29. The indicator plate 21 includes a plurality of anchor legs 23 orthogonally mounted relative to the indicator plate and extending into the fibrous strip 20. To maintain securement of the anchor legs 23, each anchor leg includes a pointed free end portion 24 having a matrix of free end barbs to maintain securement and attachment of the indicator plate. In this manner, the support rod 13 may be directed into the support tube for convenience of storage and transport and subsequently be extended to a desired orientation relative to one another for use in a driving range.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A driving range golf tee, comprising, a base plate, the base plate having a predetermined first width and a planar bottom surface, with an internally threaded support tube, the support tube orthogonally and medially mounted to the base plate, and an externally threaded rod threadedly received within the support tube, the support rod having a support rod concave top wall spaced from the support tube for receiving a golf ball on the top wall, and the base plate, the support tube, and the support rod are coaxially aligned, and a flexible mat, the flexible mat having a mat aperture, the base plate having a first width, the support tube having a second width, and the mat aperture having an aperture width, the aperture width is greater than said second width and said first width is greater than said aperture width, and the base plate positioned below the flexible mat, with the support tube extending thereabove, and the support tube includes a support tube upper distal end, and the support tube upper distal end includes a resilient locking collet mounted to the support tube upper distal end for engagement and positioning of the support rod relative to the support tube, and the support tube includes a viewing slot, and the support tube includes a support tube axis, and the viewing slot parallel to the support tube axis through-extending the support tube for indication of a lower distal end of the support rod, and a fibrous strip arranged in adjacency and in a parallel relationship relative to the viewing slot coextensive therewith, and an indicator plate, the indicator plate including a pointed end positioned in adjacency to the viewing slot for indication of the support rod lower distal end, and the indicator plate including a plurality of anchor legs, with each anchor leg orthogonally and integrally mounted to the indicator plate, with the anchor legs arranged in a parallel relationship relative to one another projected into the fibrous strip, and each anchor leg includes a pointed free end portion, and each pointed free end portion includes a matrix of free end barbs about the pointed free end portion for anchoring and securement of the anchor legs within the fibrous strip.

* * * * *